United States Patent [19]

Hiragami et al.

[11] Patent Number: 4,501,783

[45] Date of Patent: Feb. 26, 1985

[54] NON-SLIP FLOOR MATERIAL

[75] Inventors: Yoshiaki Hiragami, Mino; Mikio Yabu, Kawanishi; Yozi Kawaguchi, Itami, all of Japan

[73] Assignee: Toyo Linoleum Company, Limited, Hyogo, Japan

[21] Appl. No.: 501,558

[22] Filed: Jun. 6, 1983

[30] Foreign Application Priority Data

Jul. 6, 1982 [JP] Japan ..... 57-118086

[51] Int. Cl.[3] ..... B32B 27/40; D06N 7/04

[52] U.S. Cl. ..... 428/147; 428/240; 428/283; 428/284; 428/308.4; 428/327

[58] Field of Search ..... 428/141, 147, 327, 402, 428/403, 240, 283, 284, 308.4

[56] References Cited

U.S. PATENT DOCUMENTS

| | | | |
|---|---|---|---|
| 2,793,136 | 5/1957 | Root | 428/327 |
| 3,030,251 | 4/1962 | Bore et al. | 154/53.5 |
| 3,227,604 | 1/1966 | Morgan | 161/162 |
| 3,267,187 | 8/1966 | Slosberg et al. | 428/143 |
| 4,196,243 | 4/1980 | Sachs et al. | 428/327 |
| 4,239,797 | 12/1980 | Sachs | 428/327 |
| 4,336,293 | 6/1982 | Eiden | 428/143 |

*Primary Examiner*—Paul J. Thibodeau

*Attorney, Agent, or Firm*—Armstrong, Nikaido, Marmelstein & Kubovcik

[57] ABSTRACT

A non-slip plastics floor material having high durability and comprising a polyvinyl chloride matrix layer having synthetic resin particles dispersed therein throughout its entire thickness. The resin particles have a softening point higher than the processing temperature of the resin composition forming the matrix layer and higher abrasion resistance than the matrix layer. Some of the resin particles are exposed from the surface of the matrix layer.

10 Claims, 1 Drawing Figure

NON-SLIP FLOOR MATERIAL

Figure 1:
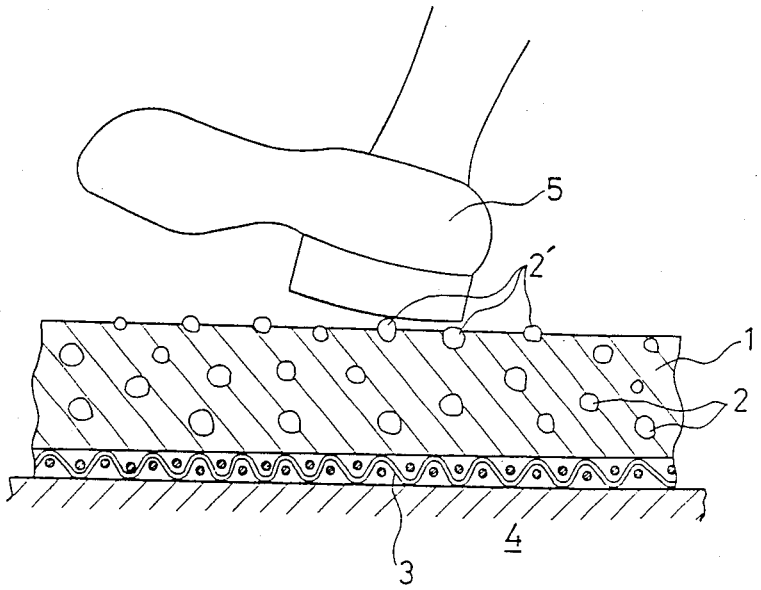

The present invention relates to a non-slip plastics floor material having durability and a substantially smooth surface which is not susceptible to soiling.

Smooth-surfaced floor materials, when wet with water, oil or the like, are usually slippery and hazardous to walk on. Accordingly research has been conducted on non-slip floor materials. Such floor materials heretofore available are prepared, for example, by mechanically embossing the surface of a sheet, or embedding grit or particles only in a surface layer, or by randomly distributing deformable or compressible resilient rubbery particles throughout an underlying continuous matrix.

However, floor materials having an embossed pattern have the drawback of being very prone to soiling due to the deposition of sand, dirt, dust or the like in the indentations of the pattern.

U.S. Pat. Nos. 3,227,604, 4,239,797 and 4,336,293, for example, disclose floor materials having grit or particles embedded in or distributed throughout the surface layer. These materials have the drawback that the surface layer, if worn by walking, no longer retains non-slip properties, rendering the material unserviceable in a short period of time when frequently walked on. Furthermore, the use of grit gives rise to the problem of causing damage to the calender rolls.

Further U.S. Pat. No. 3,030,251 discloses non-slip sheet articles comprising an essentially-continuous, flexible, readily-deformable, rubbery underlying matrix within which a multitude of discrete flexible resilient non-adhesive particles are distributed. However, none of the particles are exposed, while the particles have lower abrasion resistance than the matrix layer, are non-adhesive and are therefore easily releasable.

Further U.S. Pat. No. 3,267,187 discloses a method of preparing a sheet material having a textured surface effect by pressing into a sheet a dry blend comprising a mixture of thermoplastic resin particles and compressible, thermoset, rubber particles. The rubber particles are as large as 1/16 to ¼ inch (1.6–6.4 mm) in average diameter. The specification states, "rubber particles should be chunky, since very thin flat chips reduce the texture effect." Accordingly the textured sheet material contains a very large proportion of rubbery particles and fails to exhibit non-slip properties even when the surface wears. Thus the object of the disclosed invention is to merely provide "floor tile products having a varied surface texture or pebble effect."

The object of the present invention is to overcome the foregoing drawbacks of conventional floor materials and to provide a plastics floor material having high durability and a substantially smooth surface which is not prone to soiling and which retains non-slip properties even when worn.

The present invention provides a non-slip floor material characterized in that the floor material comprises a polyvinyl chloride matrix layer having dispersed therein throughout its entire thickness synthetic resin particles in an amount of at least 3 wt. % of the entire weight of the matrix layer, the resin particles being 100μ to 1 mm in particle size and having a softening point higher than the processing temperature of the resin composition forming the matrix layer and higher abrasion resistance than the matrix layer, a quantity of the resin particles being exposed from the surface of the matrix layer.

Examples of polyvinyl chlorides (to be referred to as "PVC") useful for forming the matrix layer of the invention are PVC homopolymer and copolymers of vinyl chloride and other monomers, such as vinyl acetate, ethylene, propylene, acrylic acid, methacrylic acid and esters thereof. With the present invention, known additives, such as plasticizer, filler and thermal stabilizer, are suitably admixed with PVC, and the mixture is made into a sheet or plate, usually about 0.1 to about 5 mm, preferably about 0.3 to about 3 mm, in thickness, usually at about 150° to about 250° C. by a known method, for example, by calendering or extrusion. According to the invention, the PVC matrix resin composition has incorporated therein synthetic resin particles.

During processing, the synthetic resin particles are slightly softened only over the surface without melting in the PVC resin composition for forming the matrix, such that the particles retain their original particulate form as dispersed throughout the entire thickness of the matrix layer, with a quantity of the particles exposed from the surface of the matrix layer. Examples of suitable particles are those of polymethyl methacrylate and like acrylic resins, polyurethane, nylon 6, nylon 66 and like nylon resins, polyethylene terephthalate and like linear polyesters, ABS resin, PVC and like synthetic resins. Such particles are not limited to fresh materials; for example, waste plastics articles are usable as pulverized.

It is required that the synthetic resin particles to be used have a softening point higher than the processing temperature of the PVC matrix resin composition and higher abrasion resistance than the matrix layer.

The abrasion resistance is determined, for example, with use of the matrix layer and the particulate synthetic resin material, each in the form of a sheet, and Taber abraser by applying a load of 500 g on each shaft of the wheels with S-33 sandpaper attached to the wheel surfaces, rotating the specimen 1000 cycles and measuring the resulting abrasion weight loss and thickness of wear. It is desired that the difference in abrasion weight loss between the layer and the particles be at least 50 mg, and that the difference in wear thickness between the two be at least 0.1 mm.

The particles are preferably in the range of 100μ to 1 mm, more preferably 140 to 500μ in particle size. When smaller than 100μ, the particles are too fine for the floor material to exhibit non-slip properties when walked on. If larger than 1 mm, particles will remain, for example, between the nipples of the calender roll or at the forward end of the extruder die and will not be uniformly distributed throughout the matrix layer, giving a faulty product. It is desirable to use at least 3 wt. % of particles based on the entire weight of the matrix layer. Although there is not particular upper limit to the amount of particles to be used, use of more than 30 wt. %, for example, of particles produces little or no enhanced effect.

The non-slip floor material of the present invention has such synthetic resin particles uniformly dispersed throughout a matrix layer formed by calendering, extrusion or like known method, with the particles retaining their original form. The product obtained has some of the particles exposed from its surface.

A sheet of foamed or non-foamed plastics, woven or nonwoven fabric of organic or inorganic fiber, or like backing can be laminated to the rear side of the floor material obtained. The product including the backing is usually about 1 to about 10 mm, preferably about 2 to about 5 mm, in thickness.

The present invention will be described below with reference to the accompanying drawing. The FIGURE is a sectional view showing a floor material of the invention. The floor material comprises a PVC matrix layer 1, synthetic resin particles 2 dispersed throughout the matrix layer, particles 2' exposed from the surface of the floor material, and a backing 3. Indicated at 4 is a floor base, and at 5 a shoe. Even when the synthetic resin particles are kneaded with the matrix resin composition at the processing temperature for the composition, the particles do not melt in the matrix forming resin composition but slightly soften only over the surface because the softening point of the particles is higher than the processing temperature. Consequently the particles retain their original form as dispersed throughout the matrix layer, with some of the particles exposed from the surface. Further because the particles intimately adhere to the matrix layer after they have slightly softened over the surface, the particles are highly compatible with the matrix layer.

When the floor material of the invention is applied onto a floor base and then actually walked on, the shoes tread some of the exposed synthetic resin particles on the matrix surface which give greatly increased friction, thus preventing continuous slippage and exhibiting outstanding non-slip properties. Since the particles incorporated into the floor material of the invention have higher abrasion resistance than the matrix layer, the exposed particles will not wear more rapidly than the matrix layer. The particles are dispersed or distributed throughout the entire thickness of the matrix layer, so that even when the matrix layer gradually wears, internal particles become exposed in succession, enabling the floor material to exhibit satisfactory non-slip properties without any change even when used for a long period of time. Further because the particles exhibit good compatibility with the matrix layer during processing, the exposed particles will not be dislodged when walked on. The surface of the material, which is substantially smooth, does not permit deposition of sand, dirt, dust or the like but retains a beautiful appearance at all times. Even when wet with water, the floor material exhibits remarkable non-slip properties.

The present invention will be described with reference to the following examples, in which the parts are by weight.

EXAMPLE 1

| | |
|---|---|
| PVC ($\bar{P}$ = 1000) | 100 parts |
| $CaCO_3$ | 50 parts |
| Stabilizer | 2 parts |
| DOP | 50 parts |
| Thermoplastic polyurethane (Note 1) | 10 parts |
| Pigment | small amount |

(Note 1) 0.2 to 0.5 mm in particle size and 200° C. in softening point. Sheet specimens of PVC materix layer and particles had therebetween a difference in abrasion weight loss of about 500 mg and a difference in wear thickness of 0.12 mm.

The above ingredients were suitably kneaded together by a Banbury mixer at about 180° C. and mixing rolls at 150° C. The resulting composition was made into a 0.5-mm-thick sheet with inverted L-shaped calender rolls while the particles still retained their original form. A PVC backing sheet, 1.5 mm in thickness, separately prepared was laminated to the sheet to obtain a non-slip floor material having the particles dispersed throughout the entire thickness of the matrix layer, with some of the particles exposed from its surface.

EXAMPLE 2

| | |
|---|---|
| PVC ($\bar{P}$ = 1050) | 50 parts |
| PVC ($\bar{P}$ = 840) | 50 parts |
| $CaCO_3$ | 50 parts |
| Stabilizer | 2.5 parts |
| DOP | 45 parts |
| Thermoplastic polyurethane (Note 2) | 20 parts |
| Pigment | small amount |

(Note 2) About 0.1 to about 0.5 mm in particle size and 210° C. in softening point. Different from matrix layer by about 500 mg in abrasion weight loss and 0.12 mm in wear thickness.

The above ingredients were made into a 1.0-mm-thick sheet using the Banbury mixer, mixing rolls and calender rolls under the same conditions as in Example 1. Two pieces of the sheet were superposed to form a surface layer, to which a 0.03-mm-thick polypropylene nonwoven fabric was laminated to obtain a non-slip floor material having the particles dispersed throughout the entire thickness of the layer, with some of the particles exposed from the surface.

EXAMPLE 3

| | |
|---|---|
| PVC/vinyl acetate copolymer (Note 3) | 100 parts |
| Asbestos | 5 parts |
| $CaCO_3$ | 200 parts |
| Stabilizer | 2 parts |
| DOP | 40 parts |
| PMMA (Note 4) | 22 parts |
| Pigment | small amount |

(Note 3) $\bar{P}$ = 800, 5% in vinyl acetate content.
(Note 4) Polymethyl methacrylate 0.1 to 0.5 mm in particle size and 190° C. in softening point. Different from matrix layer by about 890 mg in abrasion weight loss and 0.11 mm in wear thickness.

The above ingredients were premixed by a super mixer, then kneaded by mixing rolls at 120° C. and made into a 1.0-mm-thick sheet by calender rolls at 150° C. A 1.0-mm-thick-PVC backing sheet separately prepared was laminated to the sheet. Squares, about 30 cm in the length of each side, were blanked out from the resulting sheet to obtain floor tiles having the particles in the interior and over the surface.

EXAMPLE 4

| | |
|---|---|
| PVC ($\bar{P}$ = 760) | 100 parts |
| $CaCO_3$ | 40 parts |
| Stabilizer | 1.5 parts |
| DOP | 50 parts |
| Nylon 12 (Note 5) | 12 parts |
| Pigment | small amount |

(Note 5) 0.1–0.3 mm in particle size and 210° C. in softening point. Different from matrix layer by about 430 mg in abrasion weight loss and 0.10 mm in wear thickness.

The above ingredients were kneaded together by the Banbury mixer at 170° C. and by the mixing rolls at 150° C., and then made into a 0.5-mm-thick sheet by the inverted L-shaped calender rolls at 160° C. Four pieces of the sheet were laminated, and a 0.02-mm-thick vinylon woven fabric serving as a backing was applied to the laminate to obtain a floor material about 2 mm in thickness and having the particles in the interior and on the surface.

EXAMPLE 5

(1) Preparation of PVC particles

One hundred parts of PVC ($\bar{P}$=4500), 6 parts of stabilizer, 45 parts of DOP, 5 parts of epoxy plasticizer, 1 part of polyethylene wax, 0.5 part of polypropylene wax and a small amount of pigment were premixed and then made into chips by an extruder at 200° C. The chips were cooled and thereafter pulverized to obtain particles 0.3 to 1 mm in particle size and 180° C. in softening point.

(2) Preparation of floor material

| | |
|---|---|
| PVC ($\bar{P}$ = 790) | 100 parts |
| $CaCO_3$ | 35 parts |
| Stabilizer | 2.8 parts |
| DOP | 50 parts |
| Processing auxiliary agent | 10 parts |
| Pigment | small amount |

The above ingredients were premixed by a ribbon blender, kneaded by the Banbury mixer at 150° C. and by the mixing rolls at 140° C. and made into a 1-mm-thick sheet by calender rolls at 170° C. In the sheet forming step, 18 parts, based on the above composition, of PVC particles obtained by the procedure (1) and preheated to 100° C. were applied to the first bank of the calender rolls. A foamed PVC backing sheet (expansion ratio: 2 times) 2 mm in thickness and separately prepared was laminated to the sheet to obtain a non-slip elastic floor material 3 mm in overall thickness and having the particles dispersed throughout the entire thickness of the surface matrix layer, with some of the particles exposed from the surface.

The PVC particles were different from the matrix layer by about 230 mg in abrasion weight loss and 0.05 mm in wear thickness.

Table 1 shows the abrasion weight losses and wear thickness of the sheet specimens of matrix layers and particles of Examples 1 to 5 as determined by the Taber abraser.

TABLE 1

| Example<br>Particles | 1<br>Urethane | 2<br>Urethane | 3<br>PMMA | 4<br>Nylon 12 | 5<br>PVC |
|---|---|---|---|---|---|
| Abrasion wt. loss (mg) | | | | | |
| (a) Matrix | 610 | 610 | 1400 | 530 | 400 |
| (b) Particles | 101 | 101 | 506 | 100 | 170 |
| (a)–(b) | 509 | 509 | 894 | 430 | 230 |
| Wear thickness (mm) | | | | | |
| (c) Matrix | 0.17 | 0.17 | 0.33 | 0.15 | 0.12 |
| (d) Particles | 0.05 | 0.05 | 0.22 | 0.05 | 0.07 |
| (c)–(d) | 0.12 | 0.12 | 0.11 | 0.10 | 0.05 |

COMPARISON EXAMPLES 1–5

For comparison, floor materials composed only of a matix layer were prepared in the same manner as in Examples 1 to 5 with use of the same compositions as in these examples except that none of the synthetic resin particles were used.

The floor materials obtained in Examples 1 to 5 and Comparison Examples 1 to 5 were tested for non-slip properties when dry and when wet with water by the method of JIS A 1407, using a stainless steel pendulum. Table 2 shows the result.

The non-slip properties were evaluated in terms of dynamic coefficient of friction, U, according to the following criteria.

A: Least slippery (U>0.4)
B: Less slippery (U=0.25 to 0.4)
C: Slippery (U<0.25)

TABLE 2

| | Example | | | | | Comp. Ex. | | | | |
|---|---|---|---|---|---|---|---|---|---|---|
| | 1 | 2 | 3 | 4 | 5 | 1 | 2 | 3 | 4 | 5 |
| Dry slipperiness | A | A | A | A | A | B | B | C | B | B |
| Wet slipperiness | A | A | B | B | A | C | C | C | C | B |

The floor materials obtained in Examples 1 to 5 were found to have improved non-slip properties and improved abrasion resistance over those of Comparison Examples 1 to 5. The former floor materials retained non-slip properties until the materials were completely worn away to zero thickness. The materials of the invention were free from sand, dust, dirt or like deposits and were therefore maintained satisfactorily because they do not have such a distinct pattern of indentations or projections as formed in conventional materials.

We claim:

1. A non-slip floor material characterized in that the floor material comprises a polyvinyl chloride matrix surface layer having dispersed therein throughout its entire thickness synthetic resin particles selected from the group consisting of acrylic resin, polyurethane, nylon resin, polyester and ABS resin in an amount of 3 to 30 wt.% of the entire weight of the matrix layer, the resin particles being 100μ to 1 mm in particle size and having a softening point higher than the processing temperature of the resin composition forming the matrix layer and higher abrasion resistance than the matrix layer, a quantity of the resin particles being exposed from the surface of the matrix layer, wherein the difference in abrasion weight loss between the matrix layer and the particles is at least 50 mg and the difference in wear thickness between the matrix layer and the particles is at least 0.01 mm when the floor material is subjected to 1000 cycles of a Taber abraser apparatus at a loading of 500 g on each wheel, the wheels having S-33 sandpaper attached to the surfaces thereof.

2. A floor material as defined in claim 1 wherein the resin particles are in the range of 140 to 150μ in particle size.

3. A floor material as defined in claim 1 wherein the matrix layer is about 0.1 to about 5 mm in thickness.

4. A floor material as defined in claim 3 wherein the matrix layer is about 0.3 to about 3 mm in thickness.

5. A floor material as defined in claim 1 which further has a backing laminated to the rear surface thereof.

6. A floor material as defined in claim 5 wherein the backing is a sheet of one of foamed plastics, non-foamed plastics, a woven fabric of one of organic and inorganic fibers, and a nonwoven fabric of one of organic and inorganic fiber.

7. A floor material as defined in claim 5 wherein the thickness of the floor material including the backing is about 1 to about 10 mm.

8. A floor material as defined in claim 7 wherein the thickness of the floor material including the backing is about 2 to about 5 mm.

9. A floor material as defined in claim 1, wherein the resin particles are of polyurethane.

10. A floor material as claimed in claim 5, wherein the backing is a sheet of foamed plastics.

* * * * *

UNITED STATES PATENT AND TRADEMARK OFFICE

CERTIFICATE OF CORRECTION

PATENT NO. : 4,501,783

DATED : February 26, 1985

INVENTOR(S) : Yoshiaki Hiragami et al

It is certified that error appears in the above-identified patent and that said Letters Patent is hereby corrected as shown below:

Column 6, line 46, change "150μ" to --- 500μ ---.

Signed and Sealed this

*Sixteenth* Day of *July 1985*

[SEAL]

*Attest:*

DONALD J. QUIGG

*Attesting Officer* *Acting Commissioner of Patents and Trademarks*